US005584711A

United States Patent [19]

Arai et al.

[11] Patent Number: 5,584,711

[45] Date of Patent: Dec. 17, 1996

[54] ELECTRICAL CONNECTOR WITH A LATCH

[75] Inventors: Tatsuya Arai; Tsutomu Matsuo, both of Tokyo, Japan

[73] Assignee: Hirose Electric Co., Ltd., Tokyo, Japan

[21] Appl. No.: 439,372

[22] Filed: May 11, 1995

[51] Int. Cl.[6] ..... H01R 13/62

[52] U.S. Cl. ..... 439/326

[58] Field of Search ..... 439/326, 327, 439/328

[56] References Cited

U.S. PATENT DOCUMENTS 4,737,120 4/1988 Grabbe et al. ..... 439/326

5,112,242 5/1992 Choy et al. ..... 439/326

5,383,792 1/1995 Korsunsky et al. ..... 439/326

*Primary Examiner*—Neil Abrams

*Assistant Examiner*—Yong Kim

*Attorney, Agent, or Firm*—Kanesaka & Takeuchi

[57] ABSTRACT

An electrical connector with a board latch, including a board latch having a substantially L-shaped latch arm which has a latching portion on the free end for holding a board. Walls are provided around the latch arm to limit deflection of the latch arm.

6 Claims, 4 Drawing Sheets

ELECTRICAL CONNECTOR WITH A LATCH

BACKGROUND OF THE INVENTION

1. Field of the Invention

The present invention relates to electrical connectors having a board latch.

2. Description of the Prior Art

An electrical connector of this type is described in U.S. Pat. No. 4,850,892, for example. The electrical connector includes an insulating housing having a slot for receiving an edge of a board. The board receiving slot has a number of contact terminals arranged along the length thereof. The contact terminals are brought into contact with respective conductive contacts of the board inserted in the slot.

Latch arms and abutment walls are provided on opposite sides of the slot. The latch arms extend upwardly from the bottom wall of the housing and have a latch portion on a free end and are resiliently deflectable in the longitudinal direction of the housing.

To connect a board to the electrical connector, the edge portion of the board is inserted into the slot at angles to a vertical plane. The contacting forces between the edge portion and the contact terminals of the slot are designed to be substantially zero to make the so-called "zero insertion force (ZIF)" configuration. Then, the board is turned downwardly so that the upper portion of the board abuts the abutment walls of the housing. At this point, the opposite sides of the board push the latch arms outwardly so that the board passes the latch portions of the latch arms. When the board abuts the abutment walls, the latch arms resiliently return to the original position so that the board snaps into the latch portions. Under this condition, the conductive contacts of the board are brought into contact with the contact terminals while the board is held between the abutment walls and the latching portions.

To remove the latched board from the electrical connector, the latching posts are resiliently deflected outwardly so that the board passes the latching portions. Then, the board is turned downwardly and pulled up from the slot. The pull out forces are also substantially zero.

In the above electrical connector, however, the latch arms are molded integrally with the insulating housing, and the joints of the latch arms are on the upper surfaces of the connector fixing portions so that the effective resilient length is so short that the latch arms can be broken when the board is removed.

In order to solve such a problem it has been proposed to use metal latch arms. However, this solution increases the number of parts and the unit manufacturing cost. In addition, the latch arms can still be broken when the board is pulled out. The metal latches are difficult to bent at acute angles, and the angled portions are dangerous to handle. The metal latches lacking an acute angle bend fail to provide a snap feeling upon insertion of the board or complete board insertion. Moreover, small vibrations can release the latch, causing not only poor contact of the contact terminals but also loss of memory in the computer.

SUMMARY OF THE INVENTION

Accordingly, it is an object of the invention to provide an electrical connector free from such problems.

According to the invention there is provided an electrical connector with a board latch having a central section with a board receiving slot for receiving contact terminals in the longitudinal direction of the housing and a board latch provided at an end of the housing for holding a board such that the conductive pads of the board are brought into contact with the contact terminals in the slot. The board latch has a latch arm extending laterally from a joint with a lower end of an outer wall of the housing and then upwardly to form a substantially L-shaped configuration. The latch arm has a fulcrum at the joint and a free end at the top and is resiliently deflectable in the longitudinal direction. The latch arm has a latching portion at the free end and an abutment wall for cooperating with the latching portion to hold the board between the latching portion and the abutment wall.

According to an embodiment of the invention, the fulcrum of the latch arm is positioned at a level lower than the bottom of the board receiving slot. The thickness of the latch arm in the longitudinal direction is gradually decreased from the fulcrum to the free end so that surface stresses are distributed equally at every point of the latch arm upon deflection. The free end of the latch arm is surrounded by walls except the vicinity of the latching portion to limit resilient deflection of the latch arm in every direction.

It is also preferred that release projection is provided on the free end of the latch arm to facilitate release operation of the latch.

DESCRIPTION OF THE PREFERRED EMBODIMENT

Figure 2:
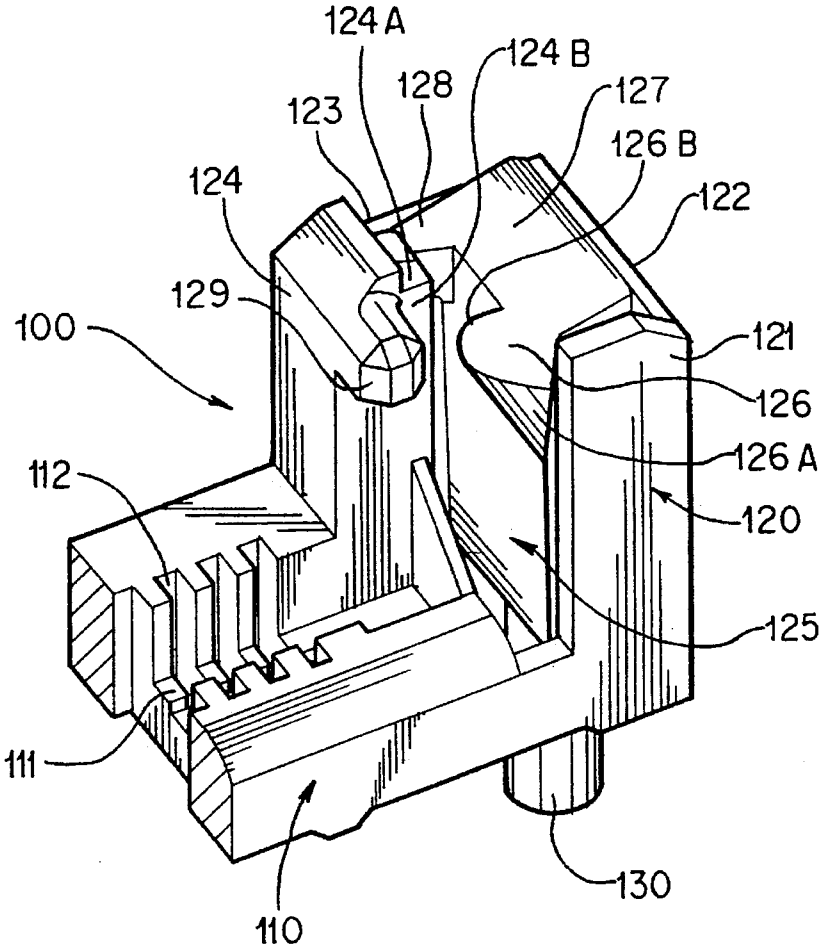
FIG. 2 is an upper rear perspective view of the right side end portion of the insulating housing.
Figure 1:
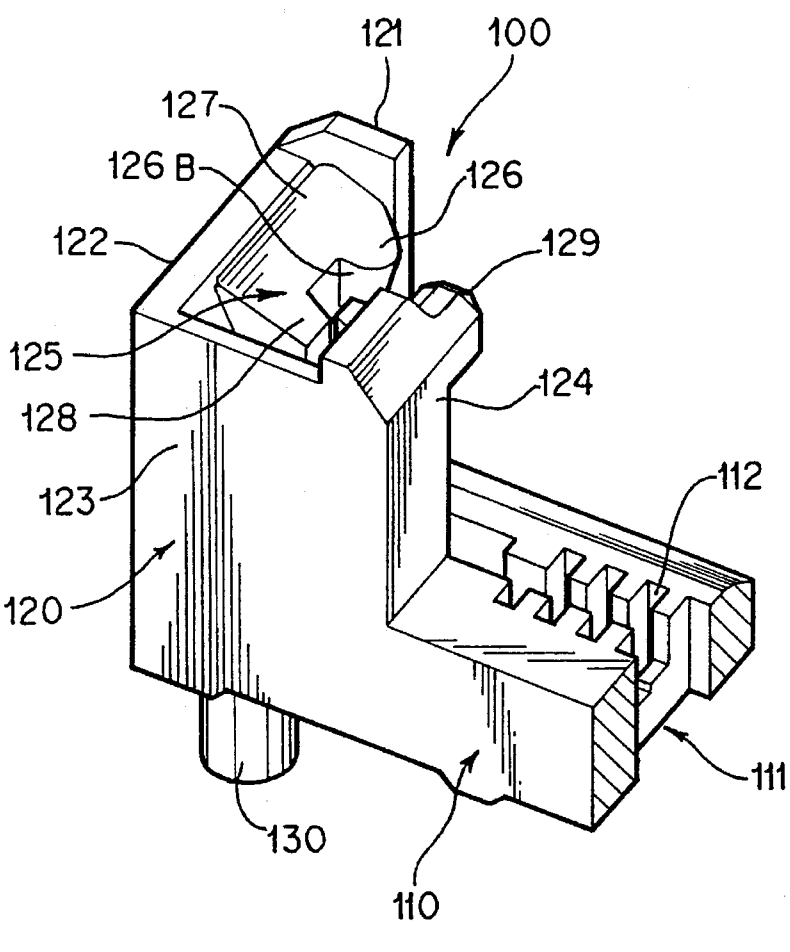
FIG. 1 is an upper front perspective view of the right side end portion of an insulating housing for an electrical connector with a board latch according to an embodiment of the invention.

FIG. 1 shows the right side portion of an insulating housing according to an embodiment of the invention. FIG. 2 is a rear view of the portion. In FIGS. 1 and 2, the insulating housing 100 has a central section 110 with a board receiving slot 111 extending in the longitudinal direction of the housing. The slot has a number of terminal channels 112 arranged in the longitudinal direction for receiving contact terminals.

Board latches 120 are provided on opposite sides of the housing 100 (only the right side portion is shown). The board latches 120 and the central section 120 are molded integrally from a plastic material to form the housing 100.

Each latch 120 includes a substantially L-shaped latch arm 125, and a front wall 121, an outer wall 122, a rear wall 123 and a forward projecting wall 124, all of which surround the latch arm 125. The forward projecting wall 124 has a protruded wall 124A extending toward the latch arm 125. The protruded wall 124A has an abutment wall 124B. A board positioning projection 129 is provided on the upper front face of the forward projecting wall 124.

Figure 3:
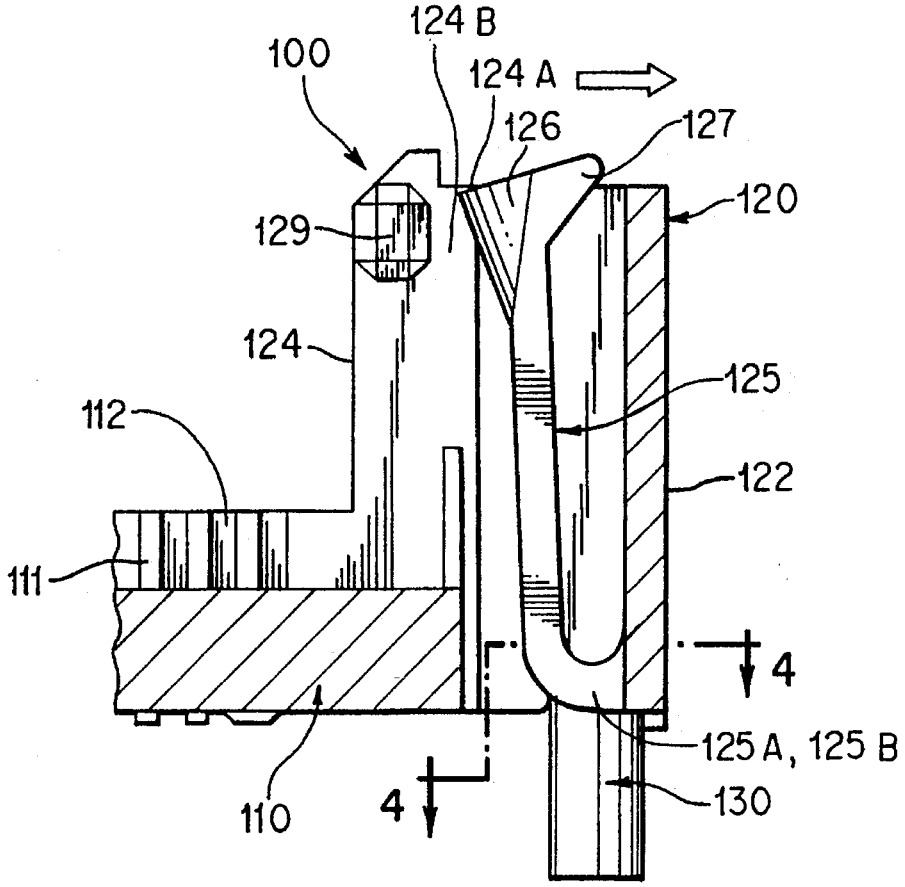
FIG. 3 is a longitudinal section of the right side end portion of the insulating housing.
Figure 4:
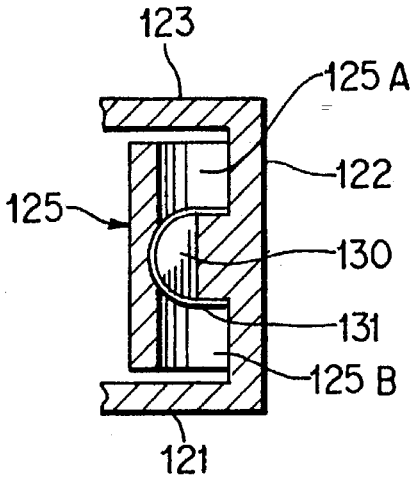
FIG. 4 is a sectional view taken along line A—A of FIG. 3.

FIG. 3 shows the section of the right side portion of the housing. FIG. 4 is a sectional view taken along line A-A of the FIG. 3. In FIGS. 3 and 4, the latch arm 125 extends laterally from the lower end of the outer wall 122 and then upwardly to form a substantially L-shaped arm. A mounting post 130 extends downwardly from each end of the housing 100 for positioning the housing 100 on a printed circuit board (not shown).

In FIG. 4, bifurcated lateral extensions 125A and 125B of the L-shaped latch arm 125 extend from the lower end of the outer wall 122 along the mounting post 130 with a space 131 between the lateral extensions 125A and 125B and the mounting post 130. This facilitates resilient deflection of the latch arm 125 not only in the longitudinal direction but also in directions perpendicular to and at angles with the longitudinal direction.

In FIG. 3, the latch arm 125 is made such that the thickness in the longitudinal direction gradually decreases from the bottom to the top so that the surface tension is made equal at every point along the latch arm upon resilient deflection. Positioning the joint between the latch arm 125 and the outer wall 122 at a level lower than the bottom of the slot makes the latch arm 125 more resilient than before within the limited height of the housing 110.

In FIGS. 1 and 2, the free end of the latch arm 125 has a latching portion 126 and a deflection limiting portion 128. The latching portion 126 is provided with a cam face 126A for facilitating the board to pass the latching portion 126 and a latch shoulder 126B for engaging the board. The deflection limiting projection 128 extends inwardly up to the protruded wall 124A of the forward projecting wall 124.

The front wall 121, the outer wall 122, the rear wall 123, and the forward projecting wall 124 surround the free end of the latch arm 125 except for the vicinity of the latching portion 126 to limit deflection of the latch arm 125 in every direction.

The deflection of the latch arm 125 toward the vicinity of the latching portion 126 is limited by the abutment of the limiting portion 128 against the protruded wall 124A of the forward projecting wall 124.

A release projection 127 is provided on the free end of the latch arm 125 to facilitate release operation of the latch. In FIG. 3, with such a release projection 127, it is easy to deflect outwardly the latch arm 125 in the longitudinal direction as shown by an arrow.

Figure 5:
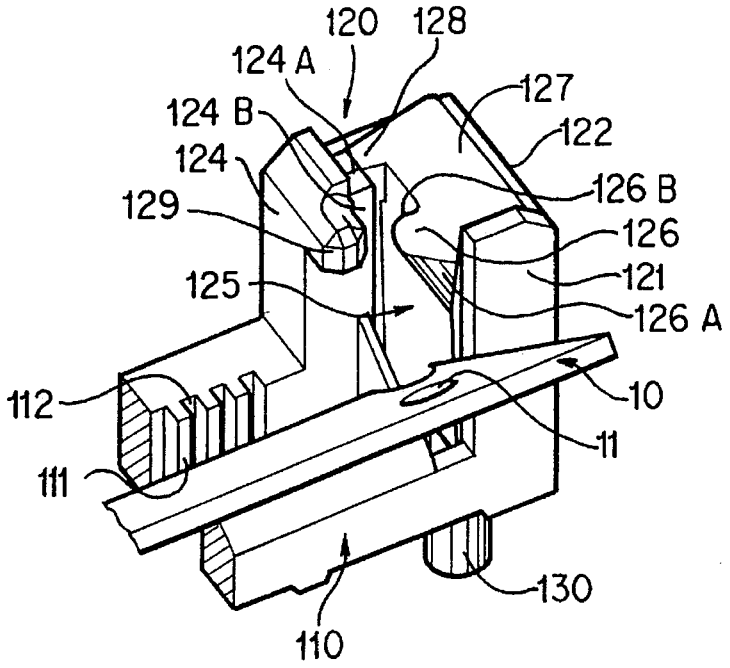
FIG. 5 is au upper front perspective view similar to FIG. 1, wherein a board is being inserted into the slot of the housing.
Figure 6:
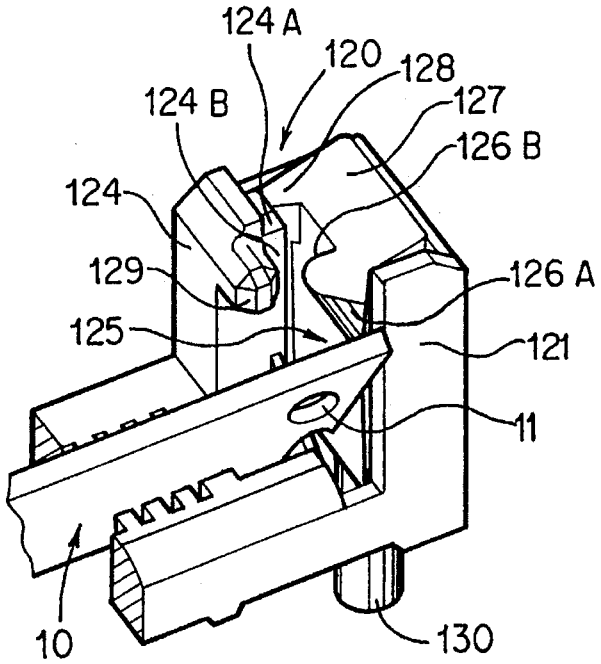
FIG. 6 is an upper front perspective view similar to FIG. 1, wherein the board abuts the latching portions.
Figure 7:
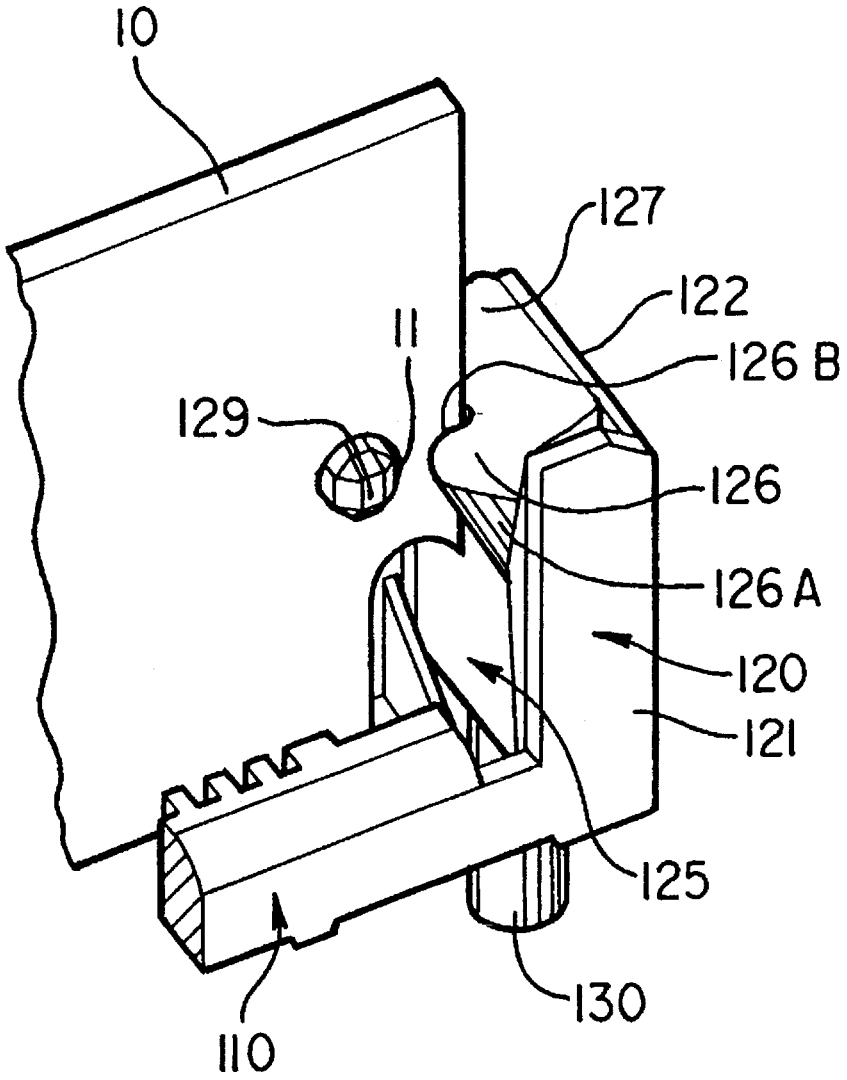
FIG. 7 is an upper front perspective view similar to FIG. 1, wherein the board is latched to the electrical connector.

Reference is made to FIGS. 5–7 to describe how to plug a board in and out of the electrical connector.

In FIG. 5, the edge portion of a board 10 on which conductive contacts are arranged is inserted into the slot 111 at an angle of 30° for example, with respect to a vertical line. Then, the board 10 is turned toward the abutment wall 124B of the latch 120 or the vertical position against resilient forces of the contact terminals in the contact channels 112. In FIG. 6, the board 10 comes to abut the cum face 126A of the latching portion 126.

When the board is further turned toward the vertical position, the cum face 126A is pushed outwardly so that the latch arm 125 is deflected outwardly allowing the board 10 to pass the latching portion 126. When the board 10 abuts the abutment wall 124B, the latch arm 125 returns to the original position so that the shoulder 126B of the latching portion 126 snaps the board 10. The board 10 is snapped in the latching portion 126 while the positioning projection 129 of the latch 120 is fitted in the positioning hole 11 of the board 10. This is shown in FIG. 7.

In FIG. 7, the board 10 is latched to the insulating housing 100, with opposite sides held between the abutment walls 124B of the latches 120 and the shoulders 126B of the latch arms 125, and the conductive contacts of the board 10 are brought into contact with contact terminals of the slot 111.

To remove the board 10 from the electrical connector, the release projections 127 of the latch arms 125 are pulled outwardly to release the shoulders 126B of the latch portions 126 from the board 10. The resilient forces of the contact terminals in the slot 111 then turn the board 10 to the position of FIG. 5. The board 10 now can be pulled out from the slot 111 in an oblique direction. As in the usual ZIF connectors, the contact pressures of the contact terminals against the board 10 is substantially zero so that the board 10 can be pulled out with very small forces.

Alternatively, the walls surrounding the latch arm for preventing overload on the latch arm may be replaced by any structure wherein the latch portion is placed at such a position as to limit deflections of the latch arm in every direction.

Since the latch arms are formed in an L shape, the latch arms deflect not only in the longitudinal direction of the housing but also in a direction parallel to the latch arms or in a twisted direction so that the latch arms are escaped from the stresses in every direction, thus minimizing the braking of the larch arms.

Since the fulcrum or joint of the latch arms is placed at a level lower than the bottom of the slot, the latch arms are more resilient than before within the limited height of the housing so that the latch arms are very flexible but snap the board without failure.

Since the thickness of the latch arms in the longitudinal direction is gradually decreased from the fulcrum or joint to the free end, the surface stresses are distributed equally at every point of the larch arm upon deflection, thus minimizing the braking of the latch arms.

The deflection limiting walls provided around the latch arm in every direction further minimize the braking of the latch arms by overload thereon.

By minimizing the braking of the latch arms, it is possible to mold the latch arms integrally with the housing with a plastic material, thereby reducing the unit manufacturing cost.

The molding makes it easy to form complex shapes and thus the latching portions capable of snapping the board without failure.

The molding also makes it easy to form the release projection on the free end of the latch arm.

What is claimed is:

1. An electrical connector with a board latch, comprising:

an elongated central section made from an insulation material so as to have front, rear, and bottom walls to define a board receiving slot extending in a longitudinal direction of the central section and receiving a plurality of contact terminals therein;

said front and rear walls having end portions extending upwardly beyond said central section;

an outer wall extending across said front and rear end portions to define a substantially rectangular space;

a latch arm having a lateral section extending laterally from a lower end of said outer wall and a vertical section extending upwardly from said lateral section to form a substantially L-shaped latch arm configuration within said substantially rectangular space, said latch arm being deflectable in the longitudinal direction and having a latch portion on a free end; and an abutment wall extending upwardly from an end portion of said central section and cooperating with said latch portion to hold a board between them.

2. An electrical connector according to claim 1, wherein said lower end of said outer wall is at a level lower than a bottom of said slot.

3. An electrical connector according to claim 1 or 2, wherein said latch arm has a thickness gradually decreased from said joint to said free end so that surface stresses are distributed equally at every point of said latch arm upon deflection.

4. An electrical connector according to claim 1, or 2, wherein said board latch is provided with walls around said latch arm except for a vicinity of said latch portion for preventing overdeflection in any direction.

5. An electrical connector according to claim 1, or 2, wherein said free end of said latch arm is provided with a release projection for facilitating a release operation of said latch.

6. An electrical connector according to claim 1, or 2, which further comprises a mounting post extending downwardly from said outer wall through said lateral section of said latch arm with a gap provided between said mounting post and said latch arm so that said latch arm is bifurcated at said lateral section of said latch arm.

* * * * *